US006257942B1

(12) United States Patent
Groover

(10) Patent No.: US 6,257,942 B1
(45) Date of Patent: Jul. 10, 2001

(54) PHOSPHORESCENT RESCUE LINE THROW-BAG

(76) Inventor: J. Steven Groover, 11625 Falconhill Dr., Whittier, CA (US) 90604

( * ) Notice: Subject to any disclaimer, the term of this patent is extended or adjusted under 35 U.S.C. 154(b) by 0 days.

(21) Appl. No.: 09/664,215

(22) Filed: Sep. 18, 2000

(51) Int. Cl.[7] ..... B63C 9/26
(52) U.S. Cl. ..... 441/84; 441/85
(58) Field of Search ..... 441/80, 84, 85

(56) References Cited

U.S. PATENT DOCUMENTS 2,722,696 11/1955 Johnson .
3,676,882 * 7/1972 Lindqvist ..... 441/85
3,972,386 * 8/1976 Hayslip ..... 182/50
4,713,033 12/1987 Cameron .
4,836,815 6/1989 Spurgeon .

* cited by examiner

*Primary Examiner*—Ed Swinehart
(74) *Attorney, Agent, or Firm*—James S. Tak

(57) ABSTRACT

A glow-in-the-dark rescue line throw-bag having a phosphorescent rope line loosely stored in a receptacle having a transparent sidewall. A first end of the phosphorescent rope line is secured to the receptacle, with the central portion of the phosphorescent rope line stored in the rope storage volume. A second end of the phosphorescent rope line may be grasped by a user at an open end of the receptacle. When the throw-bag is deployed, and upon the phosphorescent rope being substantially charged, a rescuee who has fallen into the water may easily view the glowing rope line through the transparent wall of the receptacle as it is being thrown in the air. In this manner, a rescuee may better sight where the throw-bag has landed in the water.

11 Claims, 2 Drawing Sheets

PHOSPHORESCENT RESCUE LINE THROW-BAG

BACKGROUND OF THE INVENTION

The field of the invention generally pertains to rescue equipment, and more particularly to a glow-in-the-dark rescue line throw-bag having a phosphorescent rope line which can be seen through a preferably transparent sidewall of the throw-bag.

In many emergency sea rescue operations, a lifeline or rope is typically thrown out to a person who has fallen overboard into the water. In the past, ordinary rope coiled in a bundle was used in such rescue operations by throwing the coiled bundle in the direction of the fallen passenger. Unfortunately, this method often proved inaccurate as well as failing to achieve a satisfactory distance. Moreover, it is not uncommon for rescue operations to take place during the night or when otherwise little light is available. It is very difficult to see a rope line thrown in such dark conditions, and may lead to the fallen person floundering desperately in search of the thrown rope. It is therefore particularly important in such situations that the rescuee fallen overboard not only see the thrown rope, but where the rope is being thrown judging from the trajectory of the thrown rope bundle.

Various rescue devices have been developed and used in an effort to provide a more efficient and reliable water rescue. For example, in U.S. Pat. No. 2,722,696, a lighted rescue lifeline is shown having a series of illuminated floats placed at intervals along a rescue lifeline. The floats contain lightbulbs which are powered by a conductor passing along the lifeline. This device, however, proves to be complex and expensive to manufacture and produce, requiring a multitude of electrical parts.

Additionally, in U.S. Pat. No. 4,713,033, a line throw-bag is shown having a lengthy rope line loosely stored in a bag having a weight affixed thereto. The bag has straps that are colored for high visibility, but otherwise does not have means for illuminating the bag. The high visibility colored straps would be of little use for sighting the bag during nighttime hours or in low light conditions.

In U.S. Pat. No. 4,836,815, an emergency illuminated lifeline is shown having a battery powered light at the far end thereof on a buoyant housing, for the purpose of enhancing visibility. However, because the light source is activated only upon the line being fully extended and upon subsequently jerking the line, it would be of little assistance in sighting the trajectory of the lifeline while in flight.

In summary therefore, it would be beneficial to have a rescue line throw-bag which, under nighttime conditions, a rescuee fallen into the water may easily see not only the rope extended in the water, but also the rope bundle as it is being thrown, i.e., where the trajectory of the throw-bag may be seen in flight.

BRIEF SUMMARY OF THE INVENTION

It is an object of the present invention to provide a rescue line throw-bag for use in day or nighttime water rescue operations, which may be easily viewable by a rescuee by means of observing the thrown trajectory of the rescue line throw-bag as well as the extended rope in the water.

The present invention is for a glow-in-the-dark rescue line throw-bag for use in day or nighttime water rescue operations. The glow-in-the-dark rescue throw-bag comprises a receptacle portion having a see-through sidewall surrounding a rope storage volume. In a preferred embodiment, the see-through sidewall has a cylindrical configuration and is composed of a transparent material. The see-through sidewall extends to a closed end formed by an end wall and has an open end opposite the closed end leading into the rope storage volume. The throw-bag further comprises a phosphorescent rope line having a first end fixedly attached to the receptacle. An elongated body portion of the phosphorescent rope line is loosely stored within the rope storage volume when not in use, and viewable through the see-through sidewall of the receptacle. Finally, a second end of the phosphorescent rope line is adjacently positioned next to the open end for grasping by a user. In this manner, the elongated center portion may be sufficiently charged by a light source to enable it to glow through the see-through sidewall when sufficiently dark. When the rescue throw-bag is thrown, the elongated central portion progressively exits the open end of the receptacle when the user throws the throw-bag forward while holding the second end of the phosphorescent rope line stationary.

DESCRIPTION OF THE PREFERRED EMBODIMENTS

Figure 1:
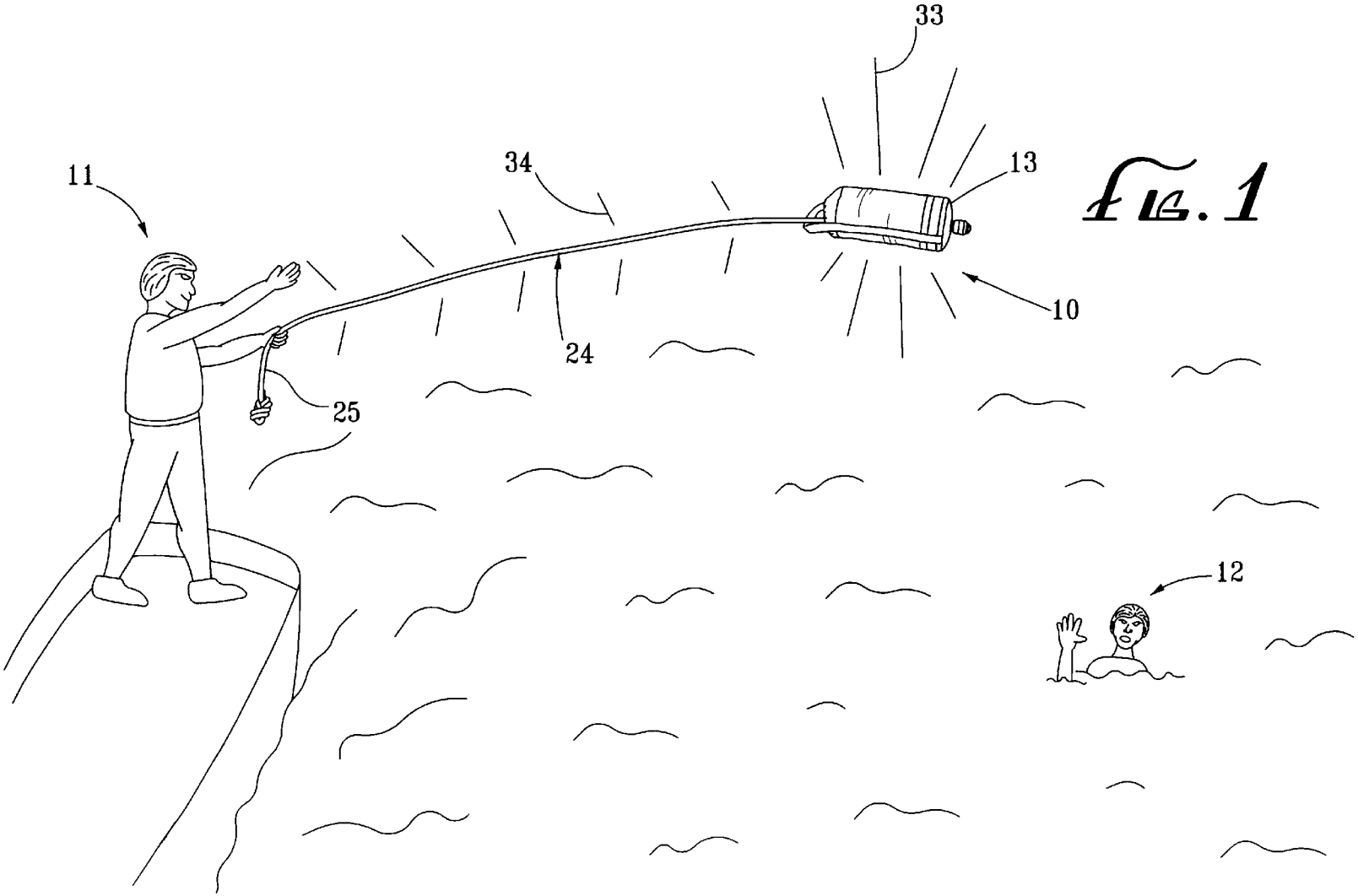
FIG. 1 is a dynamic pictorial of the glow-in-the-dark rescue line throw-bag being thrown in a rescue operation.
Figures 2, 3:
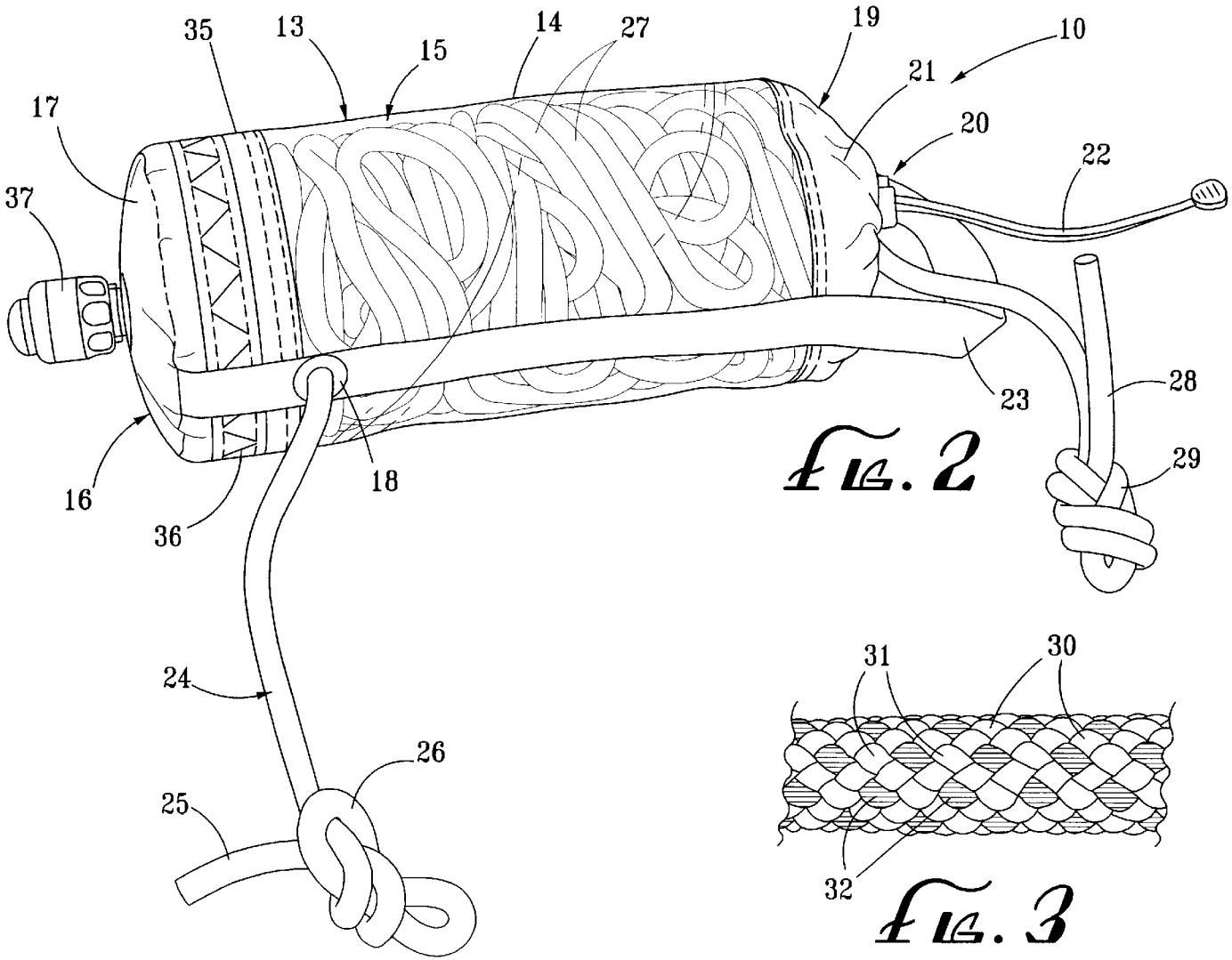
FIG. 2 is a perspective view of the glow-in-the-dark rescue throw-bag prior to deployment.
FIG. 3 is an enlarged view of a segment of the phosphorescent rope line, illustrating the illuminated rope surface.

Referring now to the drawings, FIGS. 1–3 show the glow-in-the-dark throw-bag, generally indicated as reference character 10. FIG. 1 in particular shows the construction of the rescue line throw-bag as well as its arrangement prior to deployment. The rescue line throw-bag 10 has a receptacle portion 13 preferably having a cylindrical configuration, and enclosing a rope storage volume 15. In particular, the rope storage volume 15 is surrounded by a see-through receptacle sidewall 14, which enables the contents of the rope storage volume 15 to be viewed. The see-through receptacle sidewall 14 is preferably composed of a transparent polymeric material which is preferably pliable and waterproof. It is notable, however, that the see-through receptacle sidewall 14 may alternatively have an interlaced mesh construction which enables light to pass therethrough. In any case, the see-through receptacle sidewall 14 extends to a closed end 16 formed by an end wall 17. The see-through receptacle sidewall 14 additionally extends to an open end 19 opposite the closed end 16. The open end 19 preferably includes a drawstring assembly 20 having a flexible wall 21, preferably made of Nylon, and a drawstring 22 which operates to open and close the open end 19 by opening and closing a collapsible exit hole of the drawstring assembly 20. Additionally, the closed end 16 may include additional features, such as a floatation device 35 and other features which enable a person to easily view the throw-bag 10. (See detailed discussion below.)

The throw-bag 10 further comprises a lengthy rope line, generally indicated by reference character 24. The rope line 24 has an elongated body portion 27 having a first end 25 and a second end 28. As shown in FIG. 2, the first end 25 is secured to the receptacle 13. And preferably the first end 25 is fixedly attached near the closed end 16 through an attachment hole 18. The first end 25 has a knot 26 which prevents the first end 25 from passing through the attachment hole 18. As can be seen, the first end 25 and the knot 26 are located outside of the attachment hole with the greater portion of the rope line 24, i.e. the elongated body portion 27, located within the rope storage volume 15 of the receptacle 13 prior to deployment. The elongated body portion 27 is loosely stored in the rope storage volume 15 such that it may progressively and smoothly exit the receptacle 13 during deployment without any kinks or snags. The elongated body portion 27 extends out through the open end 19 of the throw-bag 10 to the second end 28. As can be seen in the figures, the second end 28 preferably also has a knot 29 which may be used to securely fasten or otherwise hold stationary the second end 28 when deploying the throw-bag 10. For example, the knot 29 may be easily grabbed by the user, i.e. a rescuer (11 in FIG. 1), when first deploying the throw-bag 10. Moreover, the second end 28 may be fastened to a fixed object by securing a hooking device, such as a carabiner, to the knot 29.

The rope line 24 is made of a phosphorescent material which enables the rope line to glow in the dark upon being sufficiently charged by a light source. It is known that any light source, such as sunlight or an artificial source, is typically sufficient for charging a phosphorescent material. The phosphorescent quality of the rope line 24 may be integrally embedded, extruded, or otherwise formed with the rope line 24, or may alternatively be externally applied to the rope line 24 as a secondary step in a manner known in the relevant art.

It is notable that the rope line 24 preferably has a core-mantle construction, with the central core preferably composed of polyester or other floatational material. As can be seen in FIG. 3, the mantle portion of the rope line 24 is typically formed of interwoven locks or strands 30. Furthermore, while the interwoven locks 30 may be wholly comprised of and/or incorporated with phosphorescent material 31, they may alternatively be partially interwoven with light reflecting locks 32, as shown in FIG. 3, in a manner known in the relevant production art. The light reflecting locks 32 would provide an additional measure of visibility to both the rescuer and rescuee.

Additional features of the rescue line throw-bag may include a floatation material 35 which is affixed at the closed end 16. Due to its position at the closed end 16, the floatation material 35 causes the throw-bag 10 to be vertically oriented upon hitting the water. This enables a light beacon 37, such as a strobe light 37, mounted on the closed end 16, to be easily seen. The strobe light 37 would preferably be powered by a portable power source, such as a battery. Moreover, the strobe light 37 may incorporate a sounding device feature which enables a rescuee to see and hear the throw bag 10. Preferably the sounding device would also be powered by a similar portable power source. Furthermore, an additional reflective strip 36 affixed to the floatation material 35 may further provide greater visibility to the throw-bag 10.

Deployment of the rescue line throw-bag 10 can be seen in FIG. 1 where the rescuer 11 grasps the first end 25 of the rope line 24. The rescuer 11 preferably handles the throw-bag 10 at a handle portion 23 in throwing the throw-bag 10. With the drawstring assembly 20 in the open position, the elongated body portion 27 may gradually and progressively exit the open end 19 of the throw-bag 10. As can be seen in FIG. 1, the rope line 24 emits a glowing light 34 as it exits the throw-bag 10. Furthermore, the receptacle 13 itself may be seen by the rescuee 12 while the receptacle 13 is in flight. The elongated body portion 27 produces a glowing light 33 through the see-through sidewall 14 as it is projected through the air. In this manner, a rescuee 12 may sight the throw-bag 10 and its trajectory under dark conditions and the rescuee may thereby swim towards the throw-bag 10 and the rope line 24 with little confusion as to where the throw-bag 10 landed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A glow-in-the-dark rescue line throw bag comprising:

a receptacle having a see-through sidewall surrounding a rope storage volume, said see-through sidewall extending to a closed end formed by an end wall and an open end opposite said closed end leading into said rope storage volume; and a phosphorescent rope line having a first end fixedly attached to said receptacle, an elongated body portion loosely storable within said rope storage volume and viewable through said see-through sidewall of said receptacle, and a second end adjacent said open end for grasping by a user, whereby the elongated central portion, upon being sufficiently charged by a light source, glows through said see-through sidewall when sufficiently dark, as it progressively exits the second end of said receptacle when said user throws said throw bag forward with said second end held stationary.

2. The glow-in-the-dark rescue line throw bag as in claim 1, wherein said phosphorescent rope line has at least one reflective portion for reflecting light.

3. The glow-in-the-dark rescue line throw bag as in claim 2, wherein said at least one reflective portion for reflecting light is at least one reflective lock continuously extending from the first end to the second end of said phosphorescent rope line.

4. The glow-in-the-dark rescue line throw bag as in claim 1, wherein said see-through sidewall is composed of a transparent material.

5. The glow-in-the-dark rescue line throw bag as in claim 4, wherein said transparent material of said see-through sidewall is pliable and waterproof.

6. The glow-in-the-dark rescue line throw bag as in claim 1, wherein the open end of said receptacle has a drawstring assembly fixedly connected thereto for opening and closing said open end, said drawstring assembly retaining said phosphorescent rope line in said rope storage volume when closed.

7. The glow-in-the-dark rescue line throw bag as in claim 1, wherein the first end of said phosphorescent rope line is fixedly attached to the see-through sidewall at the closed end of said receptacle.

8. The glow-in-the-dark rescue line throw bag as in claim 1, further comprising flotation means fixedly connected to the end wall of said receptacle for keeping said receptacle afloat.

9. The glow-in-the-dark rescue line throw bag as in claim 8, further comprising a strobe light with first energy source means fixedly connected to said flotation means.

10. The glow-in-the-dark rescue line throw bag as in claim 8, further comprising a sounding device with second energy source means fixedly connected to said flotation means.

11. The glow-in-the-dark rescue line throw bag as in claim 8, further comprising a reflective strip fixedly connected to said flotation means.

* * * * *